United States Patent [19]

Harvey et al.

[11] Patent Number: 4,530,332

[45] Date of Patent: Jul. 23, 1985

[54] FUEL CONTROL SYSTEM FOR ACTUATING INJECTION MEANS FOR CONTROLLING SMALL FUEL FLOWS

[75] Inventors: Bruce J. Harvey, Sterling Heights, Mich.; Harold J. Laurent, Newport News; Michael A. Pauwels, Williamsburg, both of Va.

[73] Assignee: Allied Corporation, Morristown, N.J.

[21] Appl. No.: 545,792

[22] Filed: Oct. 26, 1983

[51] Int. Cl.[3] ..... F02D 5/02

[52] U.S. Cl. ..... 123/481; 123/480; 123/487

[58] Field of Search ..... 123/478, 480, 481, 487

[56] References Cited

U.S. PATENT DOCUMENTS

| | | | |
|---|---|---|---|
| 4,064,844 | 12/1977 | Matsumoto et al. | 123/481 |
| 4,196,702 | 4/1980 | Bowler | 123/478 |
| 4,200,063 | 4/1980 | Bowler | 123/478 |

FOREIGN PATENT DOCUMENTS

| | | | |
|---|---|---|---|
| 2063520 | 6/1981 | United Kingdom | 123/478 |

*Primary Examiner*—Andrew M. Dolinar
*Attorney, Agent, or Firm*—Russel C. Wells

[57] ABSTRACT

A fuel control system for actuating injection means for controlling small fuel flows is described in a microprocessor based engine control system. The short time duration fuel pulses are sensed and the control system processes the skipping of the injection pulses in the opposite direction of cylinder ignition or precesses skipping around the engine. In one example, in every three fuel pulses, one is omitted and the remaining two are increased in time duration. This processing of the fuel pulses allows each cylinder to omit receiving fuel only once in four engine cycles for a four cylinder engine. Other counts may be used providing that the count is not a multiple of a factor of the total number of cylinders. The increased time duration of the fuel pulses allows actuation of the injector in its linear region of operation.

10 Claims, 5 Drawing Figures

FUEL CONTROL SYSTEM FOR ACTUATING INJECTION MEANS FOR CONTROLLING SMALL FUEL FLOWS

This invention relates to microprocessor based engine control systems in general and more particularly to a system and method to control small fuel flows in electrical fuel injection systems.

BACKGROUND OF THE INVENTION

Microprocessor based engine control systems, wherein the system and method described herein may be used, are adequately described in a copending patent application having Ser. No. 499,110 entitled "Multiprocessing Microprocessor Based Engine Control System For An Internal Combustion Engine" filed on May 27, 1983 and assigned to the same assignee as this application. That patent application is expressly incorporated herein by reference. In that patent application there is described an engine control system utilizing dual microprocessors which receive information representing various engine operating conditions from several sensors.

These signals interact with control laws and other data and information transmitted to or contained within the microprocessors to control several engine operations such as transmission control, fuel control, EGR control, and various other operations.

SUMMARY OF INVENTION

A fuel control system for controlling small fuel flows in electrical or electronic fuel injection systems. While in the preferred embodiment the fuel control system will be described in connection with a single point fuel system, it is applicable to a multipoint system. The invention is concerned with the control of small volume fuel flows from the injector which are a result of very short, time based injector actuation pulses or fuel pulses.

The operation of electromechanical injectors, wherein the valve operates to precisely meter fuel as a function of the time that the electrical signal is applied to the device, is linear; that is, the longer the time the more fuel is discharged from the injector. However at extremely short time based operations, such as found under light load conditions, the operation is generally not linear. When the engine operates under such low fuel conditions as during deceleration conditions at high altitude, the emission control and driveability performance must be compromised.

Most solutions for solving the problem of small volume fuel flows involve various schemes involving skipping fuel pulses. The primary scheme is to double the pulse width of the fuel pulse and skip every other pulse. Since most engines have an even number of cylinders, the same cylinders are always skipped, therefore, half of the cylinders run rich and half run lean. As a result, exhaust emissions tend to fall outside of acceptable standards. With such a solution in single point fuel injection applications any bad emissions or deteriorating driveability would continue for a time after all cylinders resume operation due to manifold wall wetting conditions.

To solve all of these problems, the present fuel control system for actuating injection means to control small fuel flows was developed. In order to determine when the engine required fuel, a sensor sensed an engine operating parameter which is a function of fuel demand. Such a parameter may be air flow into the engine or manifold pressure. Each of these are proportional to fuel demand. The sensor will generate an electrical signal in proportion to the parameter sensed.

This electrical signal is supplied to a fuel pulse generating means which includes a microprocessor and other auxiliary components to generate fuel pulses having an amplitude sufficient to actuate at least one injector and time based width proportional to the amount of fuel to be injected. Each fuel pulse is counted by a counter to a predetermined count. When the counter reaches the predetermined count, a counter signal is generated to reset the counter to its beginning count value.

Designed into the system is a threshold signal calibrated the same as the fuel demand sensor. This signal indicates the value at which the range of small fuel flows begins. Thus, when the value of the electrical signal from the sensor is equal to or less than the threshold signal, a comparison signal is generated. The comparison signal is applied to a generator to generate another control pulse identified as a pulse skipping signal. The purpose of this signal is to combine with the beginning count value to generate an injection skipping signal.

The injection means responds to the fuel pulse to actuate the injection valve and to discharge fuel into the manifold as long as the valve remains open. The amount of fuel is proportional to the time base of the fuel pulse. The injection skipping signal is also applied to the injection means and when it is present, the injection means will not operate to discharge fuel into the manifold.

The pulse skipping signal, in addition to controlling the generation of the injection skipping signal, activates a multiplier. The input to the multiplier is the fuel pulse. If the multiplier is actuated, the fuel pulse is expanded by the factor of the multiplier and if the multiplier is not actuated, the fuel pulse is outputted unchanged from its input.

With the above described system, the fuel pulse skipping signal causes the missing injection pulse to be processed in the opposite direction of the firing order of the cylinders or processed around the engine. Thus, in a four cylinder engine one fuel pulse in three will be skipped, and in order to have enough fuel supplied to the engine the multiplier causes each remaining fuel pulse to be increased.

These and other objects and advantages of the fuel control system for small fuel flows will become apparent from the following detailed description and accompanying drawings.

DESCRIPTIONS OF THE DRAWINGS

DETAILED DESCRIPTION

Figure 1:
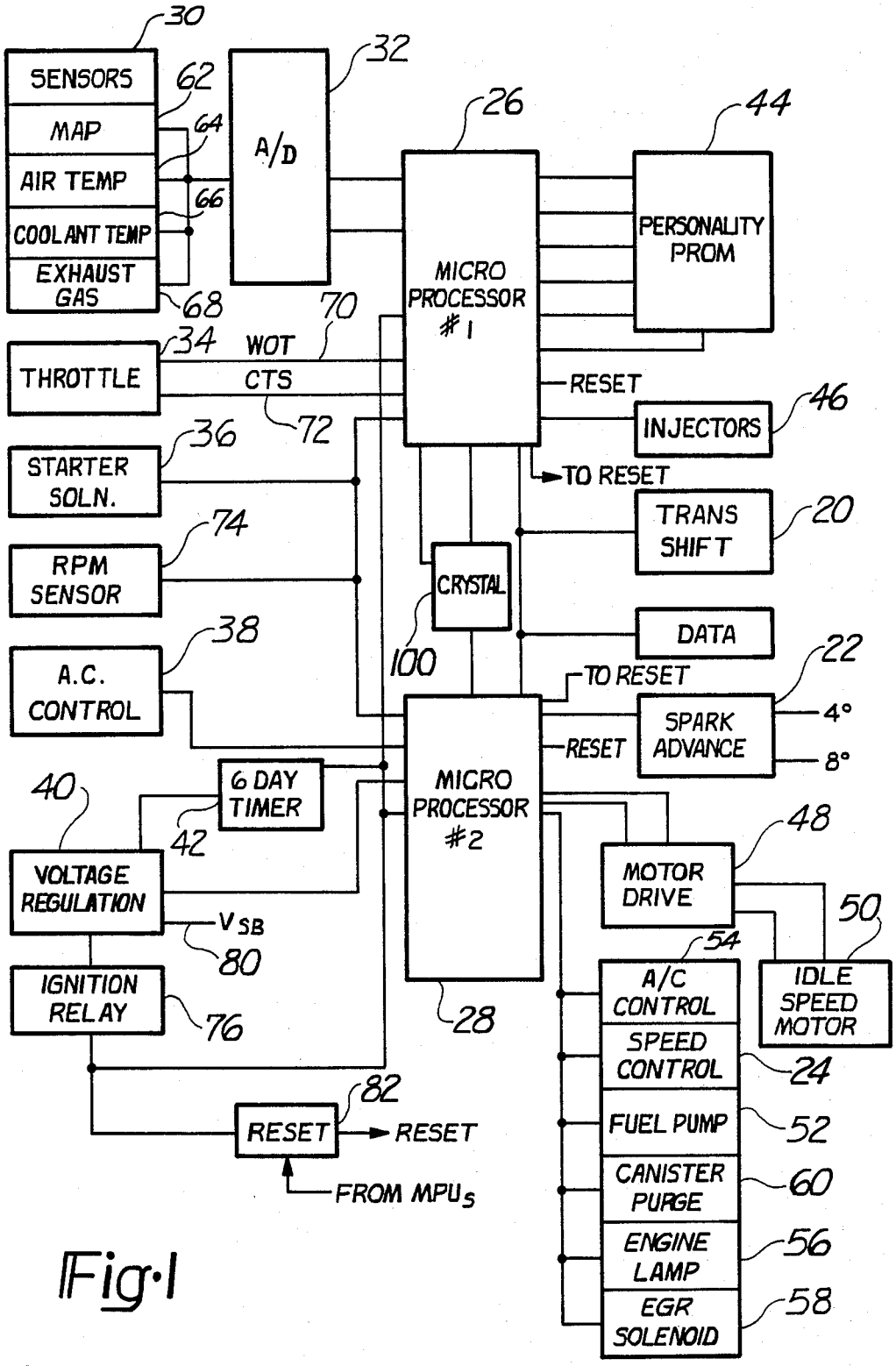
FIG. 1 is a block diagram of the microprocessor based fuel injection system.

Throughout the following description, the words "microprocessor", "processor" and "microcomputer" and "MCU" and "MPU" are used interchangeably to identify the same elements named reference characters 26 and 28. In order to aid the reader in the understanding of the basic system, copending patent application having Ser. No. 499,110 entitled "Multiprocessing Microprocessor Based Engine Control System For An Internal Combustion Engine" filed on May 27, 1983 is expressly incorporated herein by reference.

FIG. 1 illustrates a dual microprocessor based engine control system for an internal combustion engine. The particular system is dedicated mainly to fuel management although other engine control functions such as transmission shifting 20, ignition timing and control (spark advance) 22, speed control 24, etc. may either be added or the system dedicated to such function or functions.

As previously indicated, the multiprocessing microprocessor based engine control system may include control laws for generating signals for other engine functions. The information generated by the microprocessors (MPU) 26 and 28 is capable of being used to control transmission shifting either by generating signals which directly actuate the shift mechanisms or by generating a lamp signal. The lamp signal is supplied through an appropriate lamp driver circuit to turn on a lamp at those times when shifting should occur. Such a lamp may be on an instrument panel in front of the engine operator.

Ignition control including spark advance 22 is also a function which the system can control. In particular in FIG. 1 the system generates two signals to advance the spark of a spark ignited internal combustion engine by either four or eight degrees. In a compression ignited engine (diesel) the timing of injection may be adjusted according to engine loads and operating characteristics.

The system is a closed loop system having a plurality of engine mountable sensors 30, an analog to digital converter 32, throttle position switches 34, a starter solenoid responsive circuit 36, air conditioner control 38 circuitry capability, means for receiving power 40 and a timer 42 all of which supply inputs to a pair of microprocessors 26, 28 interconnected in a multiprocessing configuration. Also supplying inputs to the first microprocessor 26 is a Programmable Read Only Memory (PROM) 44 which contains information peculiar to a particular engine calibration. The output devices which are actuable by one or more control signals from the MPUs 26, 28 are injectors 46, an ignition circuit 22, an idle speed actuator including a motor drive 48 and an idle speed motor 50, an electrically responsive fuel pump 52, air conditioner controls 54, an engine warning lamp 56, an EGR solenoid 58 and a control 60 for purging the fuel evaporation canister.

The plurality of engine mountable sensors 30 provide signals having informational value representing engine operating conditions. The output of each of the sensors 30 in the preferred embodiment is an analog signal which is supplied to an analog to digital (A/D) converter 32. The A/D converts the analog signal value into a digital signal having the same informational value as the analog signal. One of the sensors is a manifold absolute pressure (MAP) sensor 62 which functions to provide information relative to the absolute pressure in the intake manifold. As is well known, the amount of manifold pressure when coupled with other information, such as speed, is an indication of the fuel requirements of the engine. In other systems, an air flow sensor, not shown, responding to the amount or mass of air being ingested into the engine also indicates fuel requirements.

A pair of temperature sensors, one for measuring the temperature of the air 64 inducted by the engine and a second for measuring the temperature of the engine coolant 66, generate output electrical signals representing the temperature of the fluid in which they are placed. For closed loop control, an exhaust gas sensor 68 is placed in the exhaust system to sense the amount of combustion of the fuel charge by the engine. In particular, an oxygen sensor measures the amount of oxygen in the exhaust gas remaining after engine combustion. The information from this sensor will regulate the fuel air ratio according to the control laws resident in the microprocessors.

The throttle position switches 34 generate an analog voltage signal which indicates the two extreme positions of the throttle valve. These positions are important to the control laws because they indicate wide open throttle (WOT) 70 and closed throttle state (CTS) 72.

The starting solenoid of the engine is operatively coupled to a starter solenoid response circuit 36 to provide a signal indicating that the engine operator is starting the engine and signifying to the control laws the need for an enriched fuel quantity signal.

A speed sensor 74 which measures the speed of an engine member provides the necessary engine speed information. Such a sensor 74 may measure the rotational speed of the engine crankshaft of a conventional internal combustion engine or the rotor speed of a Wankel engine.

In some applications, an air conditioner or other heavy engine load device is operatively coupled to a control responsive circuit 38 to generate one or more signals indicating that the load has been selected and it is operating. As will be shown, during certain engine operating conditions, the demands on the engine for power are such that certain loads should be disconnected. Air conditioning units 54 are one such load, and the engine control systems through its control laws will perform such a disconnect operation.

A power supply receiving means 40 receives both battery power and through an ignition relay 76, ignition switched power 78 for supplying electrical power to the control system. Unswitched battery power is used to maintain standby voltage 80 on certain volatile memories containing updated calibrations during the times that the engine is nonoperating. The ignition switched power 80 is used to power the control system during engine operating times upon demand of the engine operator.

Also contained in the power receiving means is a reset control 82 for responding to a sudden deregulation of the regulated supply voltage supplied to the microprocessors 26, 28. It is important that if there is a deregulation in the voltage, that microprocessors be immediately reset in order to prevent spurious and undesirable signals from generating incorrect data. Such a reset control system 82 is found in the commonly assigned U.S. Ser. No. 288,591 entitled "A Power Processing Reset System for a Microprocessor Responding to a Sudden Deregulation of a Voltage" filed on July 30, 1981 by Carp et al. which is expressly incorporated herein by reference.

As a safety factor and in order to reduce the drain on the engine power supply during very long periods of uninterrupted nonoperability, a timer 42 which is responsive to the ignition switched power 78 is used to maintain standby voltage for a given period of time. In the preferred embodiment this time is greater than five days, although such a time is merely a design selection. Such a selection of time should result in a time period measured in days as opposed to a period measured in minutes or hours. When the timer 42 times out because the engine has not been operated for a period of days, the updated engine calibrations are lost and the control system reverts back to its base line calibrations.

A Programmable Read Only Memory (PROM) which we call a Personality Programmable Read Only Memory (PPROM) 44 is provided with preprogrammed system calibration information. The PPROM 44 supplies all of the calibration constants for the engine control laws and adapts the control system to a particular engine. In particular, the PPROM 44 is a 256-byte PROM.

Figures 2, 3:
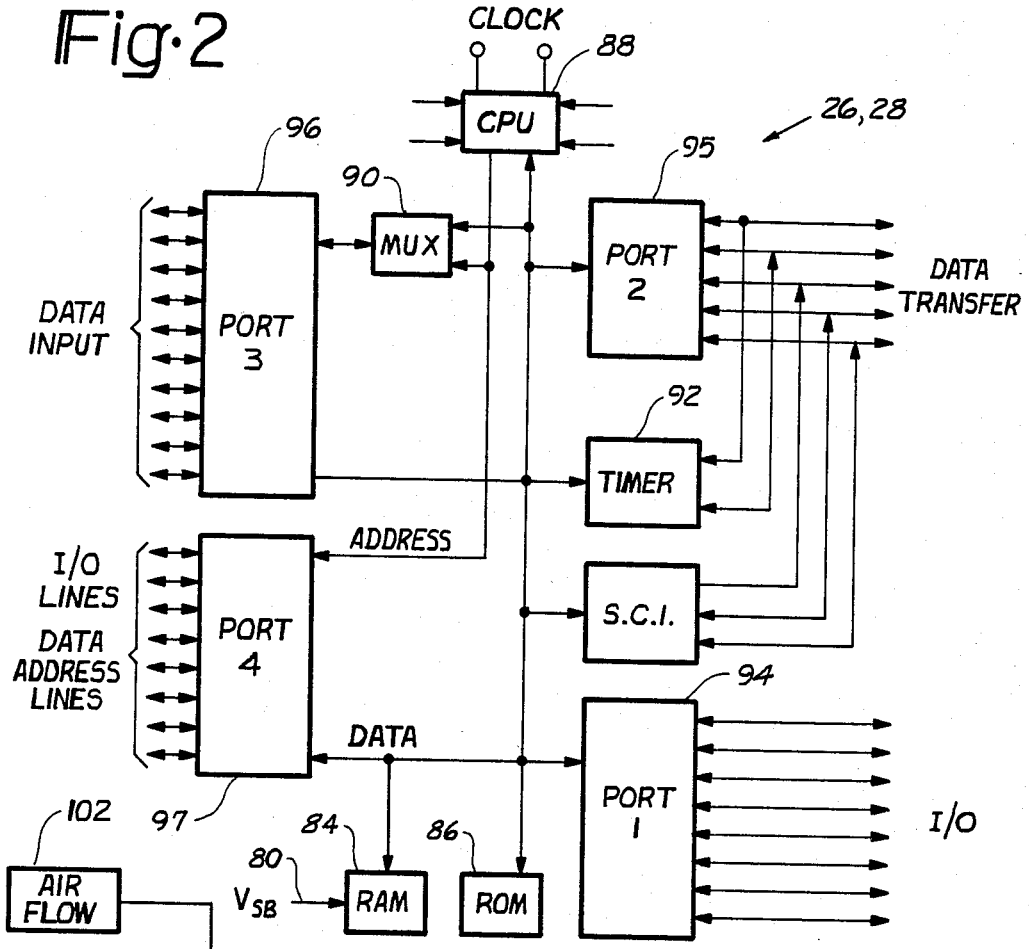
FIG. 2 is a block diagram of a microcomputer unit (MCU)
FIG. 3 is a block diagram of the small flow fuel control system.

All of the above input devices supply information to either or both of the dual microprocessors 26, 28. As previously indicated a microprocessor based system is described in U.S. Pat. No. 4,255,789 which is incorporated herein by reference. The U.S. Pat. No. 4,255,789 contains a detailed description of one of the microprocessors which description is similar to the microprocessors in the preferred embodiment. The particular microprocessor unit (MPU) or microcomputer unit (MCU) used in the preferred embodiment is a Motorola, Inc. unit MC6801 which is an improved unit of the MC6800 described in the U.S. Pat. No. 4,255,789. As is well known, each MPU has storage means in the form of Random Access Memories (RAM) 84 and Read Only Memories (ROM) 86, central processing unit 88, a multiplexor control 90, timers 92 and a plurality of input-output ports 94–97 for receiving or transmitting signals to various input-output devices. FIG. 2 is a block diagram of the microprocessors. Sometimes an MCU is defined as including an MPU, program memory and often certain I/O control. If this definition is followed the MC6800 is an MPU and the MC6801 is an MCU. In this specification the term MPU is used in the generic sense with the understanding that if an MCU is to be used the necessary modifications will be made.

The dual MPUs 26, 28 are electrically connected together in parallel to calculate from information generated by the various sensors 30, the several output control signals required by the engine control laws. The tasks required are divided by the dual MPUs wherein the first MPU 26 is assigned the task of calculating the fuel quantity signals according to stored engine control laws and calibration constants and transmitting the calculated information to the second MPU 28 for calculation of the control signals to operate various electromechanical devices controlling fuel 32, emissions 58, warning lights 56, idle speed device 48, 50 and spark ignition 22 functions.

A single frequency determining element or crystal 100 is used with the dual MPUs instead of the conventional crystal controlled oscillator with an output buffer. The single crystal 100 is so interconnected with the MPUs 26, 28 that the first MPU 26 operates as the master MPU and operates to synchronize the operation of the second MPU 28 as the slave MPU.

The fuel quantity signal or fuel pulse from the first MPU 26 is transmitted to the injector driver circuit 46 which is operatively connected to an electromechanical fuel injector mounted in the engine and upstream of the intake valves of the cylinders. If the system is a multipoint system, the several injectors are mounted to discharge fuel in the intake manifold upstream of the intake valve of each cylinder. If the system is a single point system, one or more injectors are mounted in the throttle body upstream of the throttle valve. For the purposes of the invention herein, when the multiprocessing microprocessor based engine control system is used for fuel management, the configuration and number injectors is not a constraining limitation.

The fuel quantity signal determines the initiation and duration of the actuation of the injector and the duration of actuation determines the amount of fuel injected into the engine. The injector driver circuit 46 may be that described in the commonly assigned U.S. Pat. No. 4,238,813 entitled "Compensated Dual Injector Driver" by Carp et al which issued on Dec. 9, 1980 and is expressly incorporated herein by reference.

Referring to FIG. 3 there is illustrated a block diagram of the fuel control system for controlling small fuel flows. The system comprises a sensor such as the air flow sensor 102 or a MAP sensor 62 or similar sensor, an MPU 26, a comparator 104, a pulse generator 106, a counter 108, a multiplier 110, signal generating means 112, an injector actuation means 114 and one or more injectors 46. As previously indicated many of the digital fuel control systems are speed-density systems wherein the speed of the engine and the pressure in the manifold determine the amount of fuel to be supplied to the engine. Other systems may use the amount of air or the mass of air flowing into the engine to determine the amount of fuel demanded by the engine.

The signal (DS) 115 indicating fuel demand of the engine is supplied to the MPU 26 where the information contained therein is compared with other data and control signals previously stored in the MPU. In addition, this signal is supplied to a comparator means 104 where it is compared to a threshold signal 116 supplied by the microprocessor 26 or the PPROM 44. The threshold signal 116 is a signal having a value representing the minimum fuel demand for engine operations and in particular identifies when a small fuel flow is required. The comparator 104 compares the value of the threshold signal 116 and the demand signal (DS) 115 from the sensor 62 or 102 and generates a comparison signal (CS) 118 when the demand signal 115 is less than the threshold signal 116.

The microprocessor 26 also functions to generate the fuel pulses 119 according to various control laws stored in the MPU and the demand of the engine. These fuel pulses are supplied to a counter 108 which counts the fuel pulses to a predetermined count. When the counter 108 equals the predetermined number a counter signal (PC) 121 is generated. The predetermined number may be any number that is not a multiple of a factor of the total number of cylinders in the engine. For example in a four cylinder engine, such numbers that are not divisible by, two or four can be the predetermined number. In the preferred four cylinder engine, the predetermined number is three.

The comparison signal (CS) 118 is supplied to a pulse generator 106 to generate a pulse skipping signal (PSS) 120. The pulse skipping signal 120 begins when the demand signal 115 from the sensors is less than the threshold signal 116 and will continue until such time when the demand signal 115 exceeds the value of the threshold signal 116 plus an incremental value representing hysteresis. This value may be stored in the PPROM 44. The pulse skipping signal 120 is supplied to the injector skipping signal generating means 112 along with the counter signal 121 to generate the injector skipping signal (IS) 122. The pulse skipping signal 120 is also supplied to a multiplying means or multiplier 110 which receives the fuel pulses 119 from the MPU. The multiplier 110 in response to the pulse skipping signal 120 operates to multiply the fuel pulse 119 by a predetermined factor. The multiplied fuel pulse 124 is supplied to the injector actuation means 114 for actuating the injector 46.

In the preferred embodiment, the fuel control system is used on a single point fuel injection system for a four cylinder internal combustion engine. In that system, as previously stated the predetermined number of the counter 108 is three, the factor in the multiplier 110 is 1.5, therefore, the time base of the multiplied fuel pulse 124 is 150% of the time base of the fuel pulse 119 generated by the microprocessor 26.

Operation

Fuel injectors are electromechanical devices wherein the fuel delivered by the opening or actuation of valve therein is a linear function of the open time of the valve. However, because of mechanical limitations of the injector, shorter length fuel pulses may operate the injector in a non-linear area. Such shorter pulse lengths are generated during times of small fuel flows required by lightly loaded engines.

During such small fuel flows vehicle emissions and driveability may be adversely affected. Driveability will be affected because the amount of fuel may be less than desired, therefore the engine will be operating lean. Emissions will be affected because the air fuel ratio may be other than stoichiometric.

Figure 4:
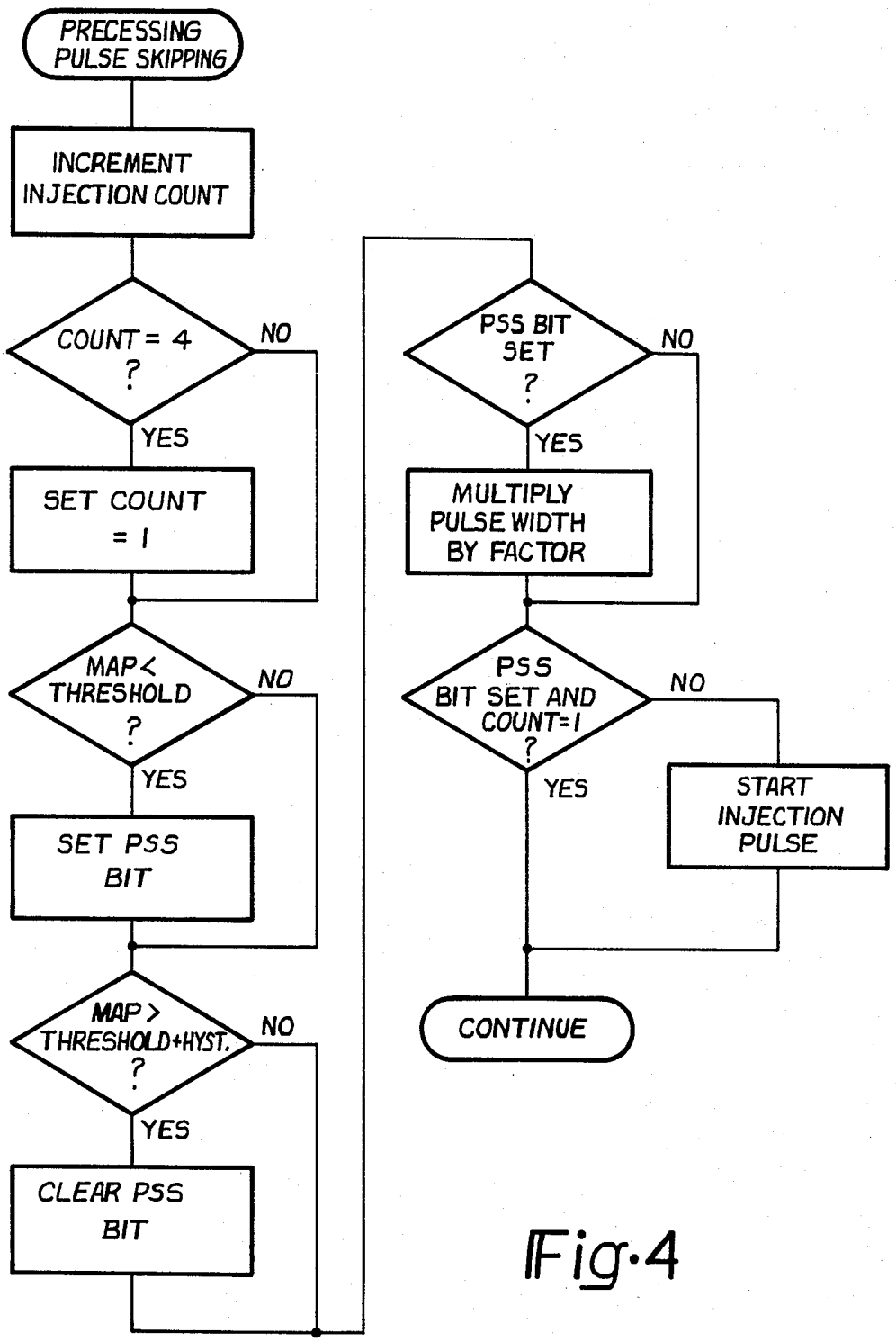
FIG. 4 is a flow chart of the small flow fuel control system.

Referring to the flow chart of FIG. 4, the operation of the small-fuel flow system will be explained. A counter 108 is programmed to count each injection pulse or fuel pulse 119 generated by the MPU 26. As there are four cylinders, the counter will count to four.

Each time the counter equals the predetermined number the counter signal 118 is generated. The value of the MAP sensor 62 or air flow sensor 102 is compared with the value of the threshold signal 116 which is a characteristic of the engine.

The threshold is a predetermined value representing the designed minimum fuel demand allowed for good vehicle operation. If the value of MAP is less than the threshold value, a PSS signal 120 is generated as a result. In software, this PSS signal 120 is a flag bit in a program and in hardware it is a binary valued signal. If the comparison of the MAP value and the threshold value results in the MAP value being greater, the MAP value is then compared with a second predetermined value which is the first predetermined value plus an incremental value. The incremental value represents an hysteresis value in the operation of the MAP sensor and allows for fluxuations in the fuel demand signal or MAP to be discounted. If the MAP value is greater than the second predetermined value, then the PSS signal is reset to the opposite binary value or the flag bit is cleared.

If the PSS signal 120 is on or the flag bit is set, this indicates a small fuel flow condition. During such a condition, one of the fuel pulses 119 is not used. In order to have different cylinders operate without fuel, the system herein causes the omitted fuel pulse to process in the opposite direction of cylinder ignition or precess around the engine. Thus, during the initial engine cycle, the cycle wherein the small fuel flow condition was determined, the fourth cylinder will be skipped. In the next succeeding four engine cycles, the third, second, first and fourth cylinders will not receive a fuel pulse. Thus, every third fuel pulse will be effectively omitted from actuating the injector.

If the PSS signal 120 is on, a multiplying means 110 is activated which causes each fuel pulse 119 to be increased in pulse length by a predetermined factor. In the present four cylinder engines, the factor is one hundred fifty percent. Therefore for every three injections, the total fuel will be three units from two cylinders instead of three units from three cylinders. The factor is a value which is a characteristic of the engine and may also be stored in the PPROM 44. The injector actuation means 114 is not activated in the presence of the PSS signal 120 and the counter signal 118. During all other count values, the injector actuation means 114 is activated.

Figure 5:
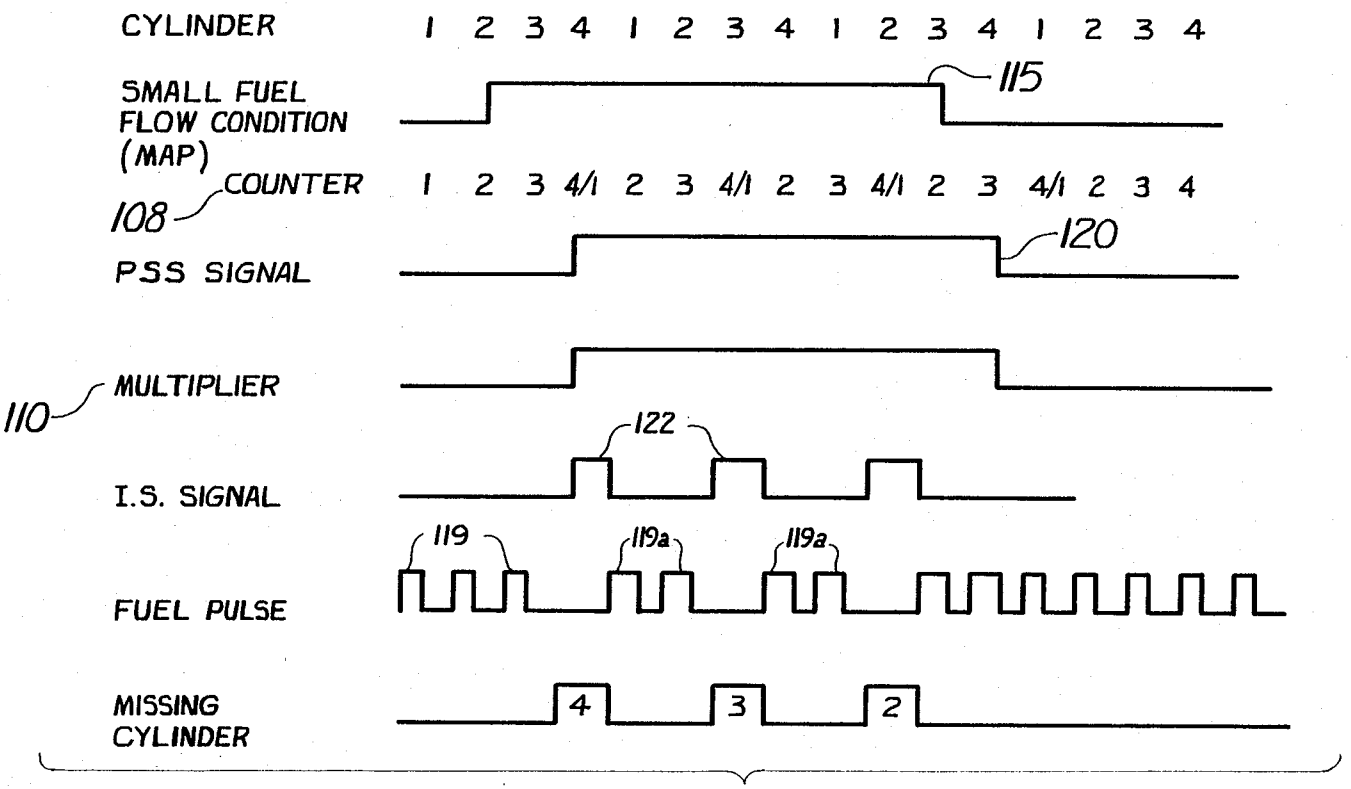
FIG. 5 is a time chart of the small flow fuel control system.

FIG. 5 is a timing chart illustrating that the fuel pulses 119 are one unit long just before the small fuel flow condition and that for every three pulses during small fuel flow two of the fuel pulses 119A are lengthened and the third is missing.

There has thus been shown and described a small fuel flow control system which may be implemented in either hardware control or software control in an electronic fuel injection system for internal combustion engines. It is immaterial whether it is a single point or a multiple point injection system as the controlling value is the threshold value which is a function of the system architecture.

We claim:

1. A fuel control system for actuating injection means for controlling small fuel flows in a fuel injected engine having a plurality of cylinders comprising;

signal generating means responsive to a fuel demand condition of the engine for generating a demand signal proportional to the amount of fuel demanded by the engine;

fuel pulse generating means responsive to said demand signal for generating fuel pulses for activating the injection means in a predetermined order of cylinder injection during each engine cycle according to the demands of the engine, said fuel pulses having a time width proportional to the amount of fuel to be injected into the engine;

threshold means for generating a threshold signal indicating a small fuel flow demand for the engine;

comparison means responsive to said demand signal and said threshold signal and operative for generating a pulse skipping signal when said demand signal is less than said threshold signal;

counter means for counting said fuel pulses, said counter means operative to count to a predetermined number and reset said counter means to a beginning count value;

means responsive to said beginning count value and said pulse skipping signal for generating a pulse skipping signal; and injection actuation means responsive to said fuel pulses and the absence of said pulse skipping signal for actuating the injection means and in the presence of said pulse skipping signal to skip actuating the injection means at a different time during each engine cycle in a predetermined order of skipping, opposite to said predetermined order of cylinder injection.

2. The system of claim 1 additionally including multiplying means responding to said pulse skipping signal to increase the time width of each fuel pulse by a predetermined factor.

3. The system of claim 1 wherein the signal generating means is an absolute manifold pressure sensor located in the intake manifold of the engine responding to the pressure therein.

4. A fuel control system for actuating injection means for controlling small fuel flows to each engine cylinder in a fuel injected engine, the system comprising:

pulse generating means responsive to engine fuel demands for generating fuel pulses having a pulse width proportional to an amount of fuel to be injected;

a counter counting said fuel pulses, said counter having a maximum count equal to the total number of engine cylinders;

means for resetting said counter to a beginning count value when said counter equals said maximum count;

a control signal generator responsive to said engine fuel demand for the engine being in a small fuel flow condition to generate a control signal;

a multiplier responsive to said control signal to increase the pulse width of each of the subsequent said fuel pulses by a predetermined factor; and injection actuating means responsive to said multiplied fuel pulse and the counter not equal to said beginning count value to actuate the injection means in a predetermined order of cylinder injection and the counter equal to said beginning count value to skip actuating the injector means in an order opposite to the order of cylinder injection.

5. A method of fuel control for actuating injection means for controlling small fuel flows in a fuel injected engine having injection means by means of skipping actuation pulses in an order inversely to the order of cylinder injection, the method comprising the steps of:

sensing the fuel demand of the engine;

generating in response to said sensed engine fuel demand, fuel pulses having a pulse width proportional to an amount of fuel;

counting the fuel pulses;

determining when the count equals a predetermined number and resetting the count to a beginning count value;

comparing the value of said sensed engine fuel demand to a first predetermined value;

generating a control signal when the value of said sensed engine fuel demand is less than the first predetermined value indicating a small fuel flow condition for generating a pulse skipping signal;

multiplying the pulse width of each subsequent fuel pulse in response to said control signal by a predetermined factor; and then actuating the injection means at a time determined by the next multiplied fuel pulse in response to said control signal and the count not equal to said beginning count value and skipping actuation of the injection means in response to said control signal and the count equal to said beginning count value thereby processing the skipping of actuation times during each engine cycle in an order inversely to the order of cylinder injection during each engine cycle.

6. The method according to claim 5 wherein the step of sensing the fuel demand comprises the steps of:

sensing the manifold pressure in the intake manifold of the engine; and then generating a signal representative of value of the manifold pressure.

7. The method according to claim 5 additionally including the steps of:

generating a second predetermined value having a value equal to the value of the first predetermined value plus an incremental value representing an hysteresis value;

comparing the value of said sensed engine fuel demand with the second predetermined value; and then resetting the control signal when the value of said sensed engine fuel demand is greater than the second predetermined value.

8. The method according to claim 5 where in the step of multiplying, the factor equals approximately one hundred fifty percent.

9. A method of fuel control for actuating injection means for controlling small fuel flows in a fuel injected engine, the method comprising the steps of;

generating in response to engine fuel demands, fuel pulses having a pulse width proportional to an amount of fuel to be injected;

counting the fuel pulses to a predetermined number of fuel pulses;

resetting the count to a beginning count value when the count equals a predetermined number of fuel pulses;

generating a control signal when the fuel pulse width is less than a predetermined value indicating that the fuel demand for the engine is in a small fuel flow condition;

multiplying the fuel pulse width by a predetermined factor in response to the control signal; and then actuating the injection means with the multiplied fuel pulse and the count not equal to said beginning count value in a predetermined order of cylinder injection and skipping actuating the injection means when the count is equal to said beginning count value thereby processing the skipping of multiplied pulses in an order inversely to the order of cylinder injection.

10. A method for controlling small fuel flows to individual cylinders of an internal combustion engine by means of skipping actuation pulses to fuel injection means in an order opposite from the normal order of actuating the fuel injection means, said method comprising the steps of:

generating fuel pulses according to the demands of the internal combustion engine;

actuating the fuel injection means by each fuel pulse in a predetermined order of cylinder injection;

counting each fuel pulse to a predetermined count;

resetting the count to a beginning count value by the predetermined count;

determining when the fuel demand of the internal combustion engine is less than a predetermined value;

multiplying each fuel pulse by a predetermined factor to increase the length of such fuel pulse in response to the fuel demand being less than a predetermined value; and then skipping the actuation of the fuel injection means in an order opposite said predetermined order in the presence of the beginning count value and the determination of the fuel demand being less than the predetermined value whereby the total fuel from the multiplied fuel pulses supplied to the internal combustion engine for a complete engine cycle is substantially equal to the total fuel demand of the engine.

* * * * *